US005241130A

United States Patent [19]

Shibukawa

[11] Patent Number: 5,241,130

[45] Date of Patent: Aug. 31, 1993

[54] ELECTRONIC KEYBOARD MUSICAL INSTRUMENT WITH PEDAL EFFECT DETERMINED BY ZONE COLOR

[75] Inventor: Takeo Shibukawa, Hamamatsu, Japan

[73] Assignee: Yamah Corporation, Hamamatsu, Japan

[21] Appl. No.: 670,699

[22] Filed: Mar. 18, 1991

[30] Foreign Application Priority Data

Mar. 20, 1990 [JP] Japan ..... 2-71150

[51] Int. Cl.[5] ..... G10H 5/02

[52] U.S. Cl. ..... 84/659; 84/662; 84/746; 84/DIG. 25

[58] Field of Search ..... 84/DIG. 25, 721, 746, 84/626, 659, 627, 662, 663

[56] References Cited

U.S. PATENT DOCUMENTS

| | | | |
|---|---|---|---|
| 3,619,469 | 11/1971 | Adachi | 84/DIG. 25 |
| 4,539,884 | 9/1985 | Aoki . | |
| 4,552,051 | 11/1985 | Takeuchi | 84/626 |
| 4,706,537 | 11/1987 | Oguri | 84/746 |
| 4,829,869 | 5/1989 | Katada et al. . | |
| 4,909,121 | 3/1990 | Usa et al. | 84/627 X |
| 5,074,184 | 12/1991 | Kikumoto | 84/626 |
| 5,081,898 | 1/1992 | Fujimori | 84/626 X |

*Primary Examiner*—William M. Shoop, Jr.
*Assistant Examiner*—Jeffrey W. Donels
*Attorney, Agent, or Firm*—Spensley Horn Jubas & Lubitz

[57] ABSTRACT

An electronic musical instrument comprises a pitch designation device such as a keyboard, performance manipulators such as foot pedals, a tone color designation device such as tone color switches for designating a tone color, an effect designation device for selectively designating an effect as the effect assigned to at least one of the foot pedals on the basis of the selected tone color, and a tone generation control device for controlling the tone generation to be accompanied with the designated effect. That one pedal is assigned with a plurality of effects and a predetermined effect is automatically given correspondingly to the designation of the tone color of musical tone to be generated. For example, a sosenuto effect and a bright effect are selectively assigned correspondingly to the piano tone color and the non-piano tone color. Further, an intermediate output which increases continuously is generated when the pedal is pushed down. An output which changes multistageously step by step is generated on the basis of the intermediate output. At the time of the releasing of the pedal, a multistageous change is produced by a smaller value than that at the time of the pushing of the pedal.

4 Claims, 10 Drawing Sheets

FIG. 2B

| TONE COLOR NUMBER | TONE COLOR |
|---|---|
| 0 | PIANO 1 |
| 1 | PIANO 2 |
| 2 | PIANO 3 |
| 3 | E. PIANO 1 |
| 4 | E. PIANO 2 |
| 5 | HARPSICHORD |
| 6 | CELESTA |
| 7 | VIBRAPHONE |
| 8 | STRINGS |
| 9 | ORGAN |

TC : TONE COLOR NUMBER

| | | | |
|---|---|---|---|
| TC = 0 | PIANO 1 | | SOSTENUTO |
| 1 | PIANO 2 | | SOSTENUTO |
| 2 | PIANO 3 | | SOSTENUTO |
| 3 | E. PIANO 1 | | SOSTENUTO |
| 4 | E. PIANO 2 | | SOSTENUTO |
| 5 | HARPSICHORD | | BRIGHT |
| 6 | CELESTA | | BRIGHT |
| 7 | VIBRAPHONE | | BRIGHT |
| 8 | STRINGS | | BRIGHT |
| 9 | ORGAN | | BRIGHT |

ELECTRONIC KEYBOARD MUSICAL INSTRUMENT WITH PEDAL EFFECT DETERMINED BY ZONE COLOR

BACKGROUND OF THE INVENTION a) Field of the Invention

The present invention relates to an electronic musical instrument and, more particularly, relates to an electronic musical instrument having performance manipulators such as a keyboard, pedals and so on, and capable of imitatively generating the tone color of a selected musical instrument such as a piano or the like.

b) Description of the Related Art

In general, a piano as a natural musical instrument has three pedals, namely, a right pedal, a center pedal and a left pedal. The right pedal serves as a damper pedal having a function for controlling the release rate of an envelope in a musical tone. The center pedal serves as a sostenuto pedal having a function for controlling the decay characteristic of a musical tone. The left pedal serves as a soft pedal having a function for controlling the tone color of a musical tone. By using the three pedals respectively, an expression is given to a generated musical tone.

An electronic musical instrument can generate musical tones with various tone colors. Also in this type electronic musical instrument, it has been proposed that predetermined effects are given to a generated musical tone by using such pedals. For example, some electronic piano has left, center and right pedals. Such an electronic piano may further have a pedal mode switch for selecting a pedal function to assign the left pedal for one of functions such as an soft effect function, an autoplay starting/stopping function, an introduction/ending performance function, a solo style performance function, a tempo down function, a bass bend down function, etc. and assign the center pedal for one of functions such as a sostenuto on/off function, a tempo up function, a bass bend up function, etc.

The sostenuto effect is seldom used except for the tone color of a piano. Accordingly, the center pedal is seldom used except for the tone color of a piano.

SUMMARY OF THE INVENTION

An object of the present invention is to provide an electronic musical instrument which can effectively utilize a performance manipulator such as a sostenuto pedal which has been seldom used except for the tone color of a piano as described above.

Another object of the present invention is to provide an electronic musical instrument by which performance manipulators such as a center pedal and the like can produce effects other than the sostenuto effect in response to the selection of the tone color of a generated musical tone.

A further object of the present invention is to provide an electronic musical instrument having a performance manipulator capable of producing a variable effect which changes multistageously corresponding to the manipulation rate thereof.

A still further object of the present invention is to provide an electronic musical instrument having a performance manipulator capable of producing an effect with stable characteristics.

According to an aspect of the present invention, when the tone color of a musical tone to be generated is designated, an effect of the musical tone controlled by at least one pedal is selected on the basis of the designated tone color. When, for example, a piano type tone color is designated, the center pedal functions as a sostenuto pedal. When, for example, a non-piano type tone color is designated, the center pedal is automatically changed over into a bright pedal.

Because the effect of the musical tone controlled by one pedal is automatically selected on the basis of the designation of the tone color of the musical tone, the pedal can be used effectively regardless of the type of the designated tone color. Accordingly, not only the pedal can be used effectively even when a non-piano type tone color is designated, but the function of the electronic musical instrument can be improved thereby.

According to another aspect of the present invention, a performance manipulator capable of generating an output signal which changes multistageously correspondingly to the amount of manipulation is provided. The output is stable even when the amount of manipulation changes slightly on each stage.

The performance manipulator may further have a hysteresis characteristic. The output signal is stabilized even in the characteristic changing portion thereof.

BRIEF DESCRIPTION OF THE DRAWINGS

FIGS. 2A and 2B illustrate an example of the configuration of an electronic musical instrument in accordance with the present invention, in which FIG. 2A is a block diagram showing the outline thereof, and FIG. 2B is a conceptual view showing the function of a tone color switch;

FIGS. 7A and 7B are flow charts of the key processing routine, in which FIG. 7A is a flow chart of the key on event routine, and FIG. 7B is a flow chart of the key off event routine.

Figure 1:
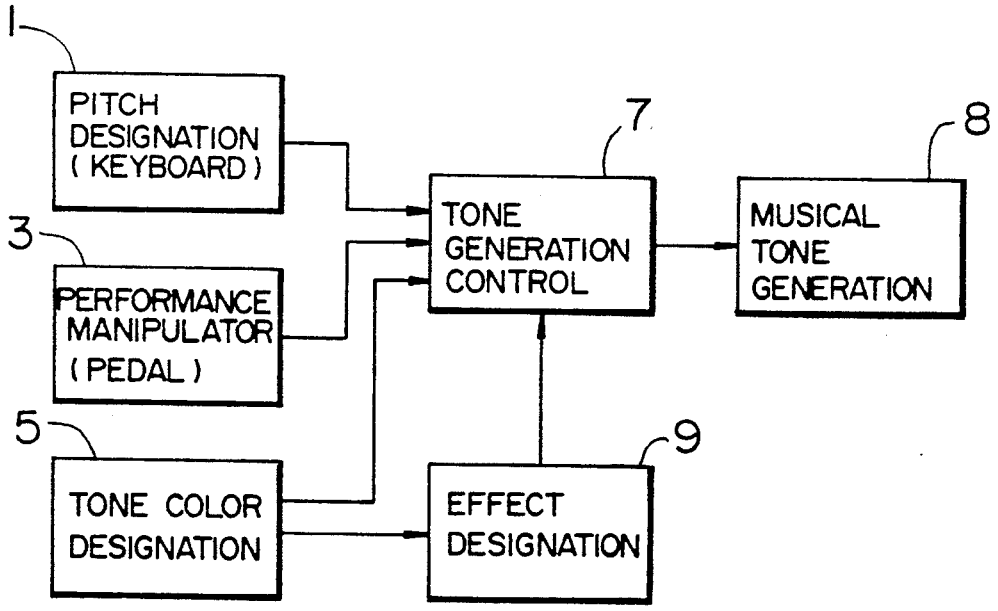
FIG. 1 is a block diagram showing the basic configuration of the present invention.

In the drawings, the reference numerals designate as follows: 1 . . . pitch designation device; 3 . . . performance manipulator (pedal); 5 . . . tone color designation device; 7 . . . tone generation control circuit; 8 . . . musical tone generating device; 9 . . . pedal effect designation device; 11 . . . bus; 13 . . . CPU; 14 . . . ROM; 15 . . . RAM; 19 . . . keyboard circuit; 25 . . . pedal switching circuit; 26, 27, 28 . . . potentiometer (26 . . . for left pedal, 27 . . . for center pedal, 28 . . . for right pedal); 31, 32, 33 . . . A/D converter; 34, 35, 36 . . . register; 41 . . . tone generator; and 42 . . . sound system.

DESCRIPTION OF THE PREFERRED EMBODIMENTS

FIG. 1 shows the basic configuration of the present invention. A pitch designation means 1 such as a keyboard having a plurality of keys designates the pitch of a musical tone to be generated on the basis of the performance manipulation. A pedal, which is a performance manipulator, gives, when manipulated, a predetermined effect to the generated musical tone. A tone color designation means 5 which is a switching means constituted by a plurality of tone color designation manipulators, etc., designates the tone color of a musical tone to be generated. When a tone color is designated by the tone color designation means 5, a pedal effect designation means 9 designates an effect to be controlled by the pedal on the basis of the designated tone color. A tone generation control means 7 generates a musical tone signal having an effect designated by the pedal effect designation means 9, on the basis of pitch information supplied from the pitch designation means 1, tone color information supplied from the tone color designation means 5 and pedal manipulation information supplied from the pedal 3. A musical tone generating means 8 forms and generates a musical tone on the basis of the musical tone signal supplied from the tone generation control means 7. In the case where the pedal 3 includes a plurality of pedals, the pedal effect designation means 9 needs not designate effects corresponding to all the pedals and may designate an effect for manipulation and control of a limited pedal on the basis of the tone color designation. When, for example, the pedal 3 includes a right pedal, a center pedal and a left pedal, only one effect to be given by the manipulation of the center pedal is designated on the basis of the tone color designation.

The present invention as to the preferred embodiment thereof will be described more in-detail hereinbelow.

Figure 2A:
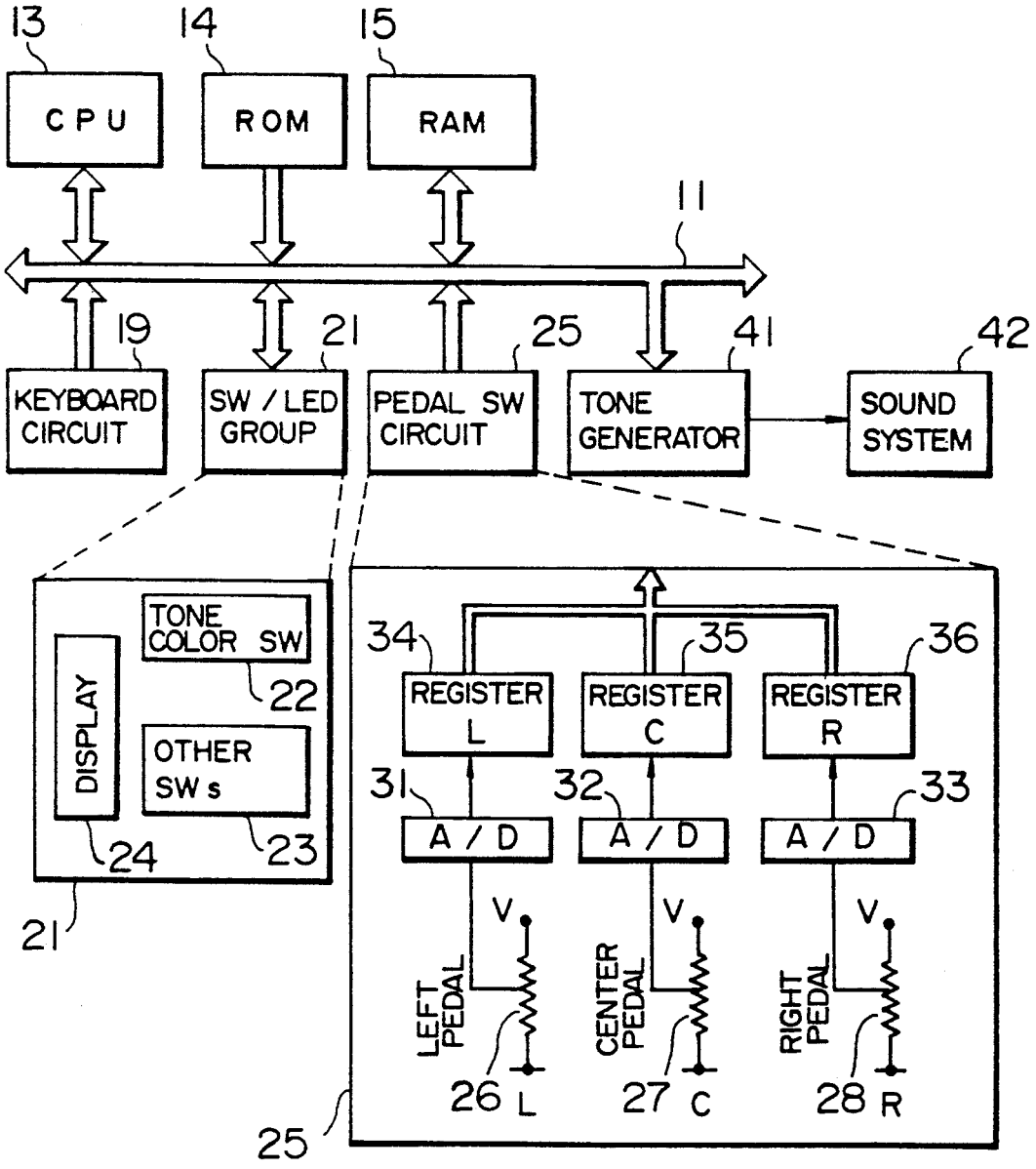

FIG. 2A shows an example of the configuration of an electronic musical instrument. In the outline view of FIG. 2A, a CPU 13 for processing a digital signal, an ROM 14 for storing a program, an RAM 15 for temporarily storing information such as data, a keyboard circuit 19 for supplying pitch information, a switch/LED group 21 for supplying information selected by various switches or the like, a pedal switching circuit 25 for giving a predetermined effect to a musical tone to be generated, a tone generator 41, etc., are connected to a bus 11. The switch/LED group 21 includes a display means 24 such as a liquid crystal display, a tone color switch 22 for selecting the tone color of a generated musical tone from a large number of tone colors, and a group of other switches 23. The pedal switch circuit 25 includes potentiometers 26, 27 and 28 for producing signal voltages corresponding to the operation of pushing of the left, center and right pedals, A/D converters 31, 32 and 33 for converting the signal voltages into digital signals, and registers 34, 35 and 36 for latching the digital signals thus formed. For example, the tone generator 41 includes a digital filter type tone color generating means and supplies an output signal to a sound system 42 to generate a musical tone.

The tone color switch 22 is a switch for selecting one from a plurality of tone colors assigned to tone color numbers displayed in a circulating manner as shown in FIG. 2B. When, for example, a tone color is selected by the tone color switch 22, the tone color is represented by the tone color number thereof.

In the pedal switching circuit 25, for example, the right pedal 28 functions as a damper pedal and the left pedal 26 functions as a soft pedal. The center pedal 27 functions as a sostenuto pedal upon the selection of piano tone colors represented by tone color numbers Ø to 4 and also functions as a 鈔 right pedal upon the selection of non-piano tone colors represented by tone color numbers 5 to 9. When the keyboard circuit 19 and the pedal switching circuit 25 are operated after the tone color switch 22 and the group of other switches 23 are subjected to performance manipulation, information based on the respective performance manipulation is inputted into the RAM 15 and processed by the CPU 13 according to the program stored in the ROM 14, so that the tone generator 41 generates a musical tone on the basis of the processing.

Work registers and the like provided in the RAM 15 store the following information.

KCD: Key code representing pitch information related to a depressed key in the keyboard circuit 19.

TC: Tone color number representing a tone color type.

TPD: Tone parameter data corresponding to the tone color number TC.

KSB: Register for use for key scan event detection for detecting the key depressing operation in the keyboard. This register is composed of a plurality of bits corresponding to respective keys in the keyboard. A bit corresponding to the depressed key is set to "1".

SPB: Sostenute pattern buffer for use for event detection in the keyboard when the sostenuto pedal (center pedal) is on. This buffer is the same as the KSB both in size and in structure.

ASCH: Information for assigning a tone generation channel in the tone generator.

DPD: Information representing the depth of the damper pedal (right pedal).

SOFPD: Information representing the depth of the soft pedal (left pedal).

SOSPD: Information representing the depth of the sostenuto pedal (center pedal).

BRPD: Information representing the depth of the bright pedal (center pedal).

Figure 3A:
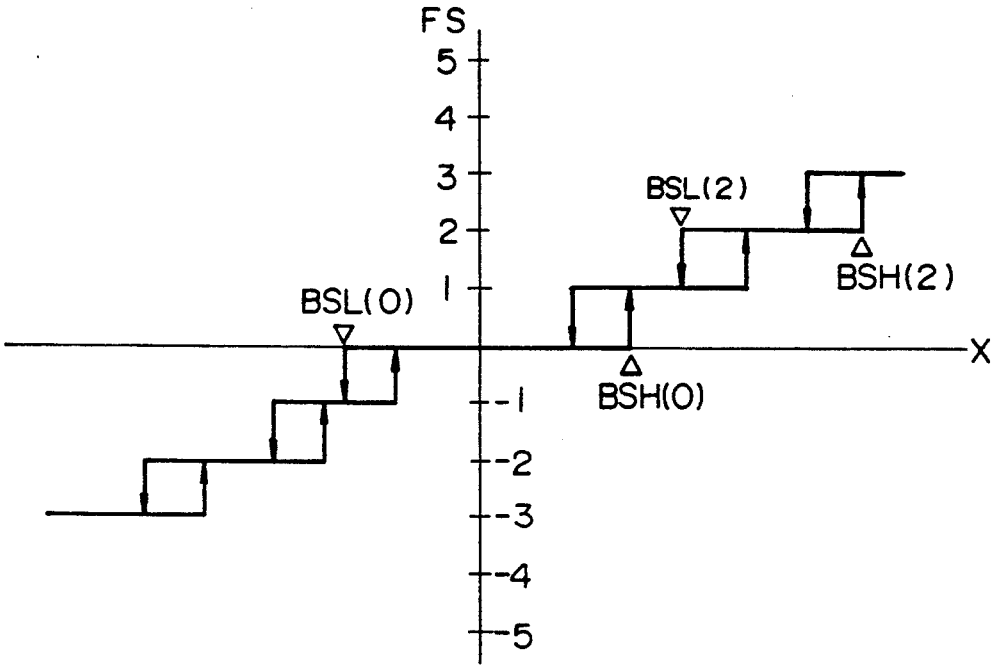
FIG. 3A is a graph showing the relationship between a parameter FS and A parameter X.
Figure 3B:
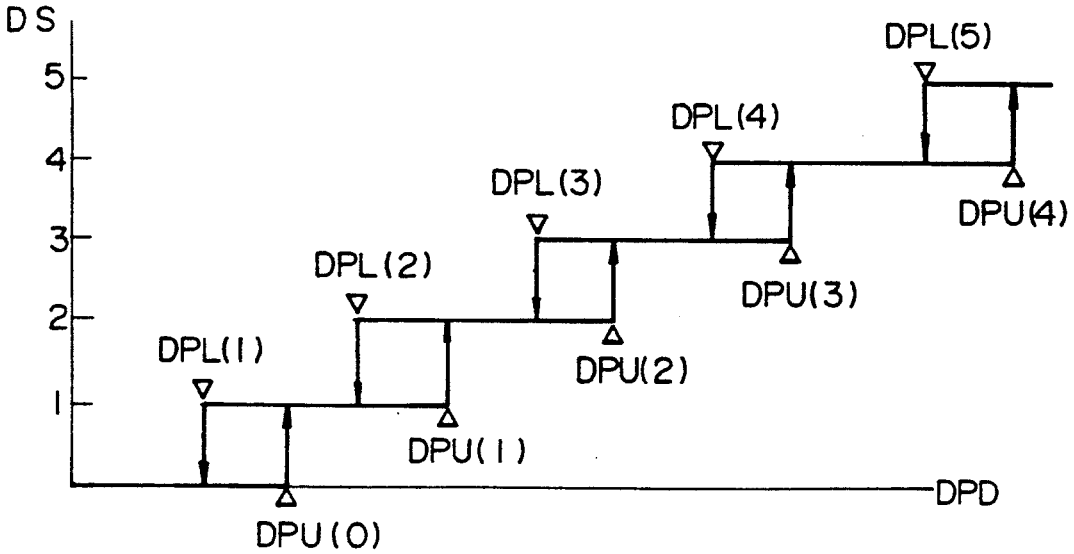
FIG. 3B is a graph showing the relationship between a parameter DS and a damper pedal depth DPD.

DS: Parameter determined on the basis of the damper pedal (right pedal) depth DPD and taking a discrete value as shown in FIG. 3B. FIG. 3B shows the conversion characteristic between the damper pedal depth DPD and the parameter DS.

SS: Flag representing the on/off of the sostenuto pedal.

FS: Parameter taking a discrete value as shown in FIG. 3A, corresponding to a parameter determined on the basis of the soft pedal depth SOFPD and the bright pedal depth BRPD in the case where the center pedal functions as a bright pedal. FIG. 3A shows the conversion characteristic between the input value X and the output value FS.

DPL: Lower limit value determined by the value of DS.

DPU: Upper limit value determined by the value of DS.

SL: Lower limit value determined for detecting the on/off of the sostenuto pedal.

SH: Upper limit value determined for judgment as to the on/off of the sostenuto pedal.

BSL: Lower limit value used for judgment as to the increase/decrease of the systhesized parameter of the bright pedal and the soft pedal and determined on the basis of the value of FS.

BSH: Upper limit value used for judgment as to the increase/decrease of the systhesized parameter of the bright pedal and the soft pedal and determined on the basis of the value of FS.

The performance manipulation of the aforementioned electronic musical instrument will be described hereinbelow.

Figure 4:
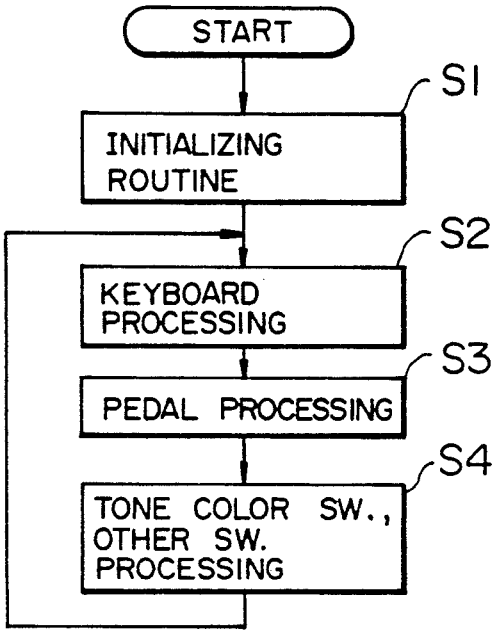
FIG. 4 is a flow chart of the main routine.

FIG. 4 is a flow chart of the main routine of the performance manipulation. When the manipulation is started, an initialization routine for initializing various registers and the like is executed in the step S1.

Then, a keyboard processing for processing the performance manipulation of the keyboard (the step S2), a pedal processing for processing the manipulation of the pedal manipulator (the step S3) and a switch processing for processing the manipulation of the tone color switch and other switches (the step S4) are executed repeatedly. Here, the order of the keyboard processing, the pedal processing and the switch processing may be changed suitably. The frequency of the switch processing may be smaller than that of the keyboard processing or the pedal processing.

In the following, the keyboard processing, the pedal processing and the switch processing are described.

Figure 5:
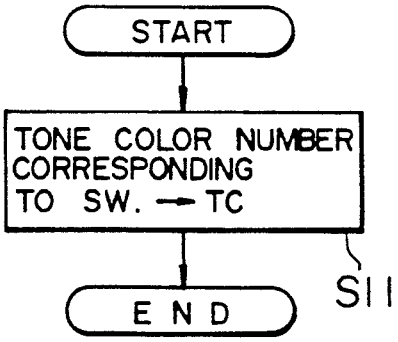
FIG. 5 is a flow chart of the tone color switch event routine.

FIG. 5 shows the tone color switch event routine. When the routine is started, a tone color number corresponding to the designated tone color is registered as a parameter TC in the step S11. In respect to the tone color parameter TC, piano tone colors are collectively arranged as shown in the right side of the drawing, so that a judgment as to whether the designated tone color is of a piano type or not can be made by the magnitude of the tone color number.

FIGS. 6A through 6D show the pedal processing routine.

Figure 6A:
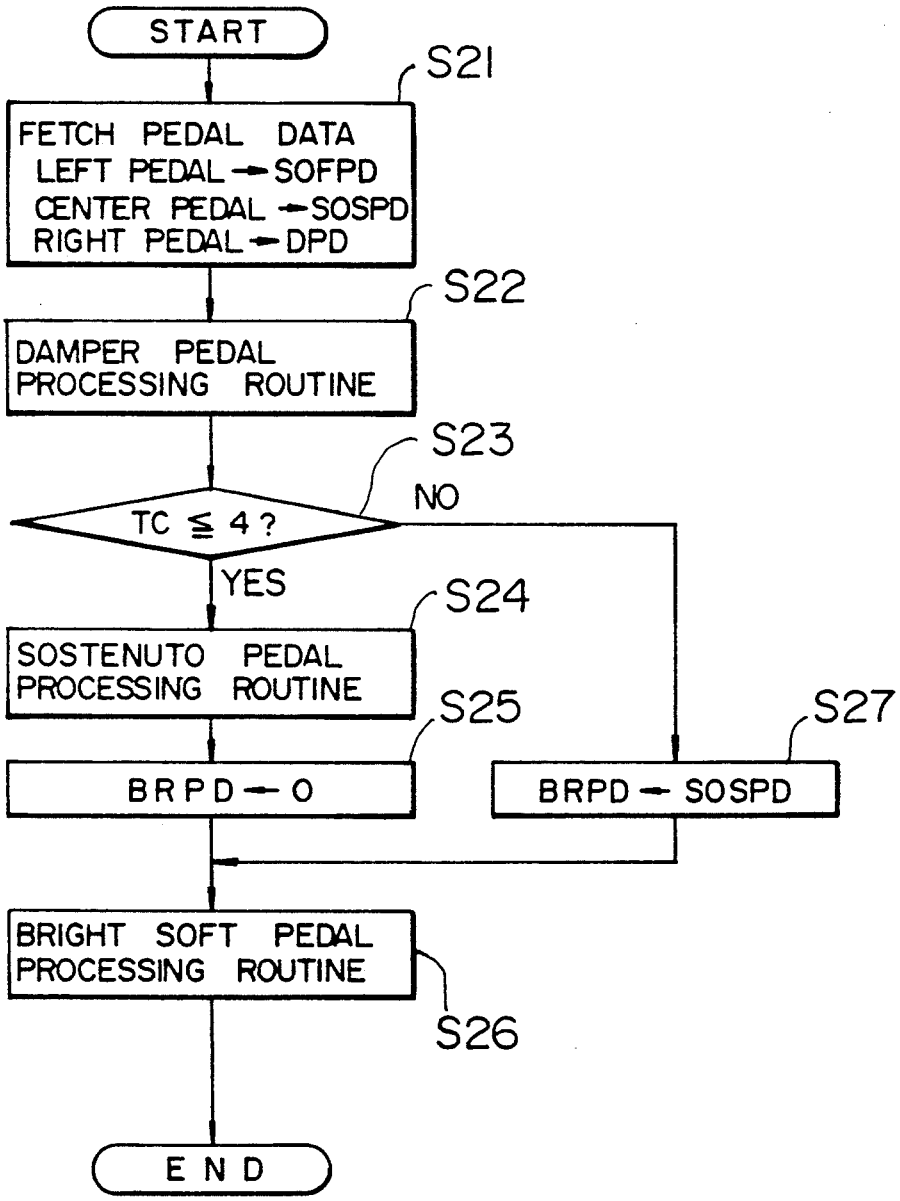
FIG. 6A is a flow chart of the pedal processing routine.

FIG. 6A schematically shows the outline of the pedal processing routine. When the pedal processing is started, pedal data are latched in the step S21. Namely, the amount of the pushing of the left pedal is detected as soft pedal depth SOFPD. The amount of the pushing of the center pedal is detected as sostenuto pedal depth SOSPD. The amount of the pushing of the right pedal is detected as damper pedal depth DPD.

Then, in the step S22, the damper pedal processing routine is executed.

Then, in the step S23, a judgment is made as to whether the tone color number TC satisfies the relation TC 4 or not. Namely, as shown in FIG. 5, a judgment is made by the relation TC 4 as to whether the designated tone color is of a piano type or not.

In the case where the tone color is of a piano type represented by the relation TC 4, the situation goes to the step S24 according to the arrow of YES to give a sostenute effect. In the step S24, the sostenuto pedal processing routine is executed.

Then, in the step S25, a bright pedal parameter BRPD not used in this mode is reset to "Ø".

Then, in the step S26, the bright pedal processing routine is executed when each of the soft pedal (left pedal) and the center pedal functions as a bright pedal. After the execution of the bright pedal processing routine, the pedal processing routine is terminated.

When the tone color number TC is larger than 4 in the step S23, that is, when the tone color is of a non-piano type, the parameter SOSPD representing pedal depth is set as a parameter BRPD representing bright pedal depth because the center pedal functions as a bright pedal. Then, in the step S26, the bright pedal processing routine is executed. That is, the bright pedal processing and the soft pedal processing controlling the cut-off frequency of a filter are collectively executed.

Here, the bright pedal processing and the soft pedal processing may be executed separately.

Figure 6B:
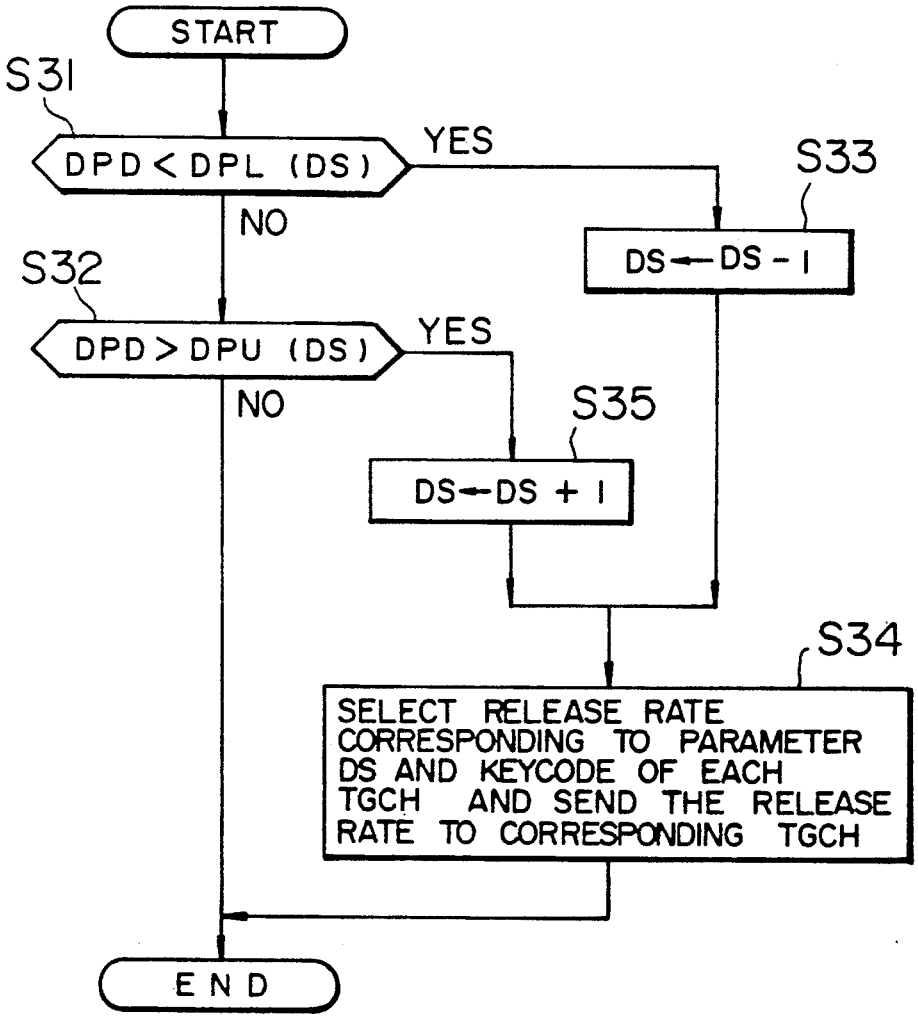
FIG. 6B is a flow chart of the damper pedal processing routine.

FIG. 6B shows the damper pedal processing routine which corresponds to the step S22 in FIG. 6A.

When the processing is started, a judgment is made as to whether the parameter DPD representing damper pedal depth is smaller than the lower limit value DPL(DS) or not in the step S31 to thereby judge whether the increase of the parameter DPD is not smaller than a predetermined value. When DPD is smaller than DPL(DS), this proves that the decrease of DPD is not smaller than a predetermined value.

When DPD is larger than DPL(DS) or equal to DPL(DS), the situation goes to the step S32 according to the arrow of NO. In this step S32, a judgment as to whether the increase of DPD is not smaller than a predetermined value or not is made by comparing DPD with the limit value DPU(DS) determined on the basis of DS at that time. When DPD is smaller than DPU(DS) or equal to DPU(DS), the processing is terminated because the value of DPD is regarded as constant.

When DPD is smaller than DPL(DS) in the step S31, the parameter DS representing the amount of the manipulation of the damper pedal is decreased by "1" (the step S33) because the releasing of the damper pedal is detected.

In the next step S34, a release rate corresponding to the parameter DS and the key code of the respective tone generation channel in the tone generator is selected and sent to the corresponding tone generation channel in the tone generator.

The parameter DS determined on the basis of the parameter DPD has such a hysteresis characteristic that different paths as [illegible] o the value of DS are formed between the time of the increasing of the value and the time of the decreasing of the value.

Accordingly, the value of the parameter DS is stable even though the value of the parameter DPD changes slightly.

The release rate corresponding to both the parameter DS and the key code may be formulated or may be tabulated as a table to be suitably read therefrom.

When DPD is larger than DPU(DS) in the step S32, the value of DS is increased by "1" in the step S35 because this represents that the pedal depth is not smaller than a predetermined value. Then, the processing in the step S34 is executed.

As described above, the decay characteristic of the musical tone is multistageously modified correspondingly to the damper pedal depth.

Figure 6C:
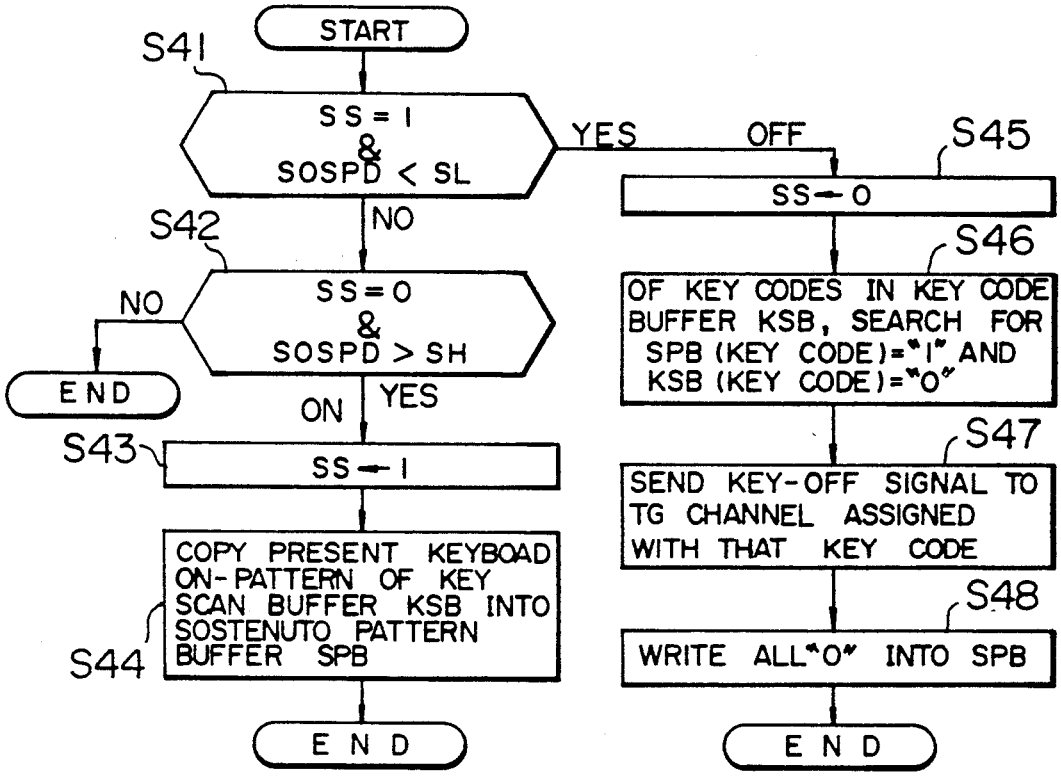
FIG. 6C is a flow chart of the sostenuto pedal processing routine.
Figure 6C:
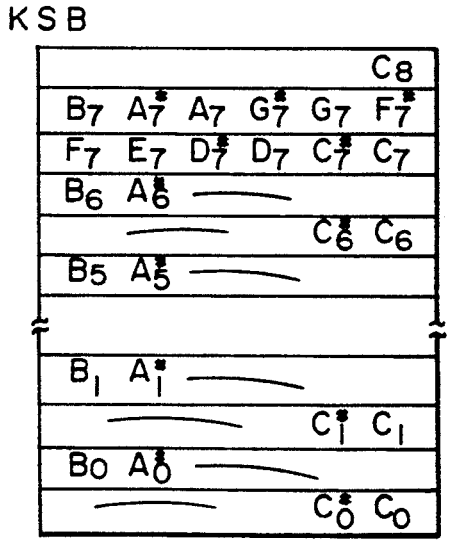

FIG. 6C shows the sostenuto pedal processing routine which corresponds to the step S24 in FIG. 6A.

When the processing is started, a judgment is made in the first step S41 as to whether the flag SS representing the manipulation of the sostenuto pedal is on ("1") and the sostenuto pedal depth SOSPD is smaller than a predetermined lower limit value SL. That is, when the sostenuto pedal is released after it is once pushed down, the result is YES because the sostenuto pedal manipulation flag SS is set to "1" by the pushing of the pedal and then the release of the pedal is detected. At this time, the processing of turning off the sostenute mode is executed as will be described later.

When the judgment in the step S41 is NO, a judgment is made in the next step S42 as to whether the flag SS is "Ø" and the parameter SOSPD is larger than an upper limit value SH.

When the above two conditions are satisfied, that is, when the sostenuto pedal is newly pushed down, the situation goes to step S43 according to the arrow of YES. In the step S43, the flag SS is set to "1" and then the sostenute mode is turned on.

Then, in the step S44, the present key on pattern registered in the key scan buffer KSB is copied to the sostenute pattern buffer SPB of the same structure as it is.

As shown in the lower side of the drawing, the key scan buffer KSB is a buffer memory for storing the value ("Ø" or "1") of one bit representing the key on/off in each of buffers CØ through C8 corresponding to the all keys in the keyboard. That is, the key code of the depressed key is detected and then the sostenute effect is given.

When the result in the step S41 is YES, the flag SS is reset o "Ø" in the next step S45 to turn off the sostenute mode. Then, in then step S46, the key code buffer KSB is searched for the key code having SPB "1" and KSB "Ø". That is, the keys registered in the sostenute pattern buffer are searched for the depressed key.

In the step S47, a key-off signal is sent to a tone generation channel of the tone generator assigned for the key code detected with respect to the key depression, so that the decay of the musical tone extended by the sostenute effect is started.

Then, in the step S48, "Ø" is written in all the bits of the sostenute pattern buffer SPB.

Figure 6D:
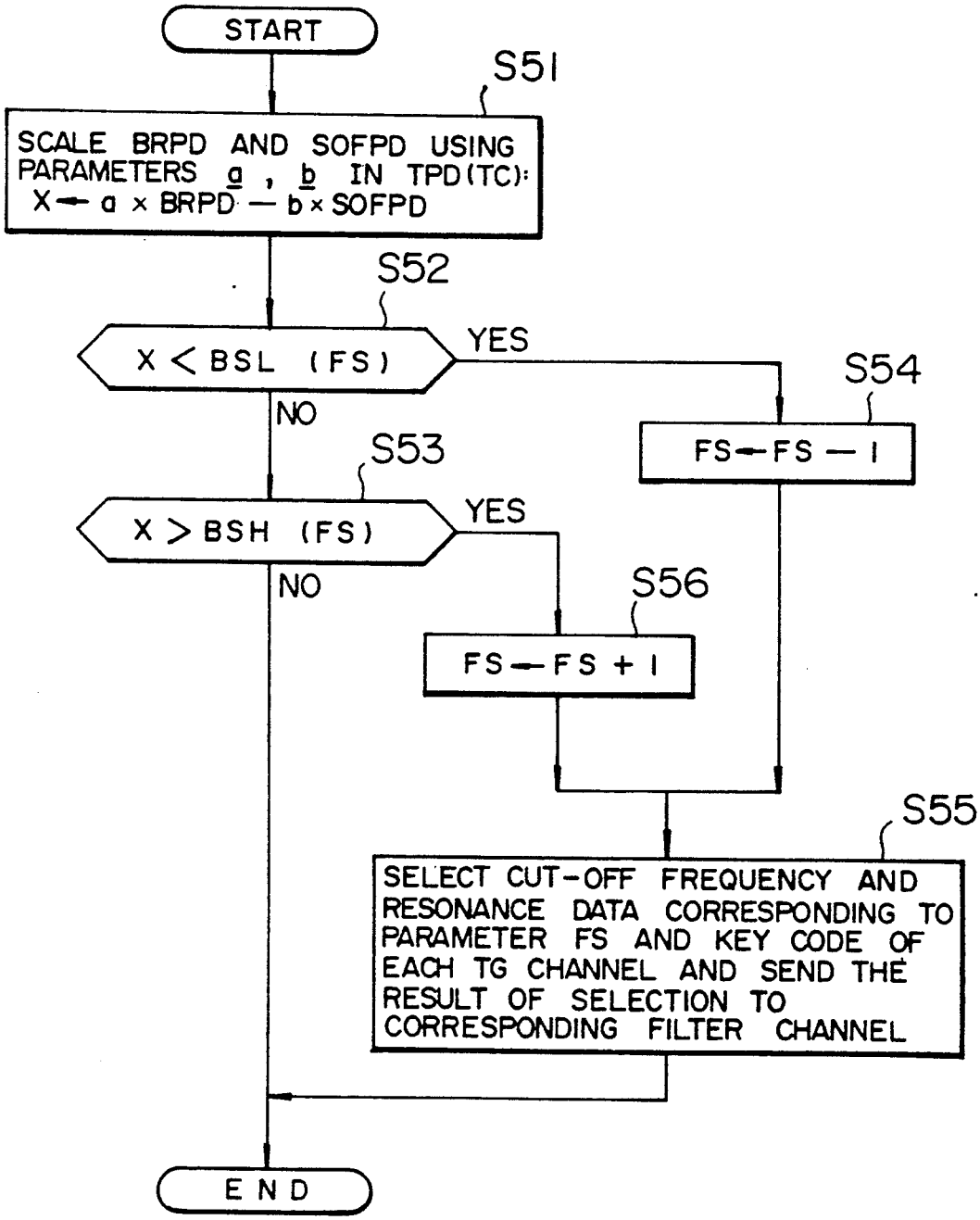
FIG. 6D is a flow chart of the bright soft pedal processing routine.

FIG. 6D shows the bright/soft pedal processing routine which corresponds to the step S26 in FIG. 6A.

When a non-piano tone color is selected, the center pedal functions as a bright pedal. At this time, the operations of the bright pedal and the soft pedal can be collectively carried out because the two pedals functionally resemble each other.

When the processing is started, a collective parameter X represented by the following formula is set in the step S51 by scaling the bright pedal depth BPPD and the soft pedal depth SOFPD by using parameters a and b (which are weighting data (constants) designated by tone colors) in the tone parameter data TPD(TC).

$$X \leftarrow a \times BRPD - b \times SOFPD$$

Then, a judgment is made as to whether the collective parameter X as shown in FIG. 3A has changed or not. That is, the parameter X is compared with the lower limit value BSL determined on the basis of the soft/bright pedal depth FS at that time (the step S52) and then compared with the upper limit value BSH(FS) (the step S53).

When X is smaller than the lower limit value BSL(FS), that is, when the decrease of X is detected, the value of the parameter FS is decreased by "1" (the step S54). When X is larger than the upper limit value BSH(FS), that is, when the increase of X is detected, the value of the parameter FS is increased by "1" (the step S56).

The processing in the next step S55 is executed on the basis of the value of the parameter FS. That is, by using the parameter FS and the key code of the respective tone generation channel of the tone generator as variables, a cut-off frequency and a resonance data are selected and read from the tone parameter data TPD(TC) and sent to a filter channel corresponding to the tone generation channel.

The cut-off frequency and the resonance data read on the basis of both the FS and the key code may be tabulated so that they can be read out suitably.

As X increases, FS increases. As FS increases, both the cut-off frequency of the filter and the resonance quantity increase. Accordingly, when the bright pedal is pushed deeply, the generated tone is brightened.

As X decreases, FS decreases. As FS decreases, both the cut-off frequency of the filter and the resonance quantity decreases. Accordingly, when the soft pedal is pushed deeply, the generated tone is mellowed.

As described above, the tone color can be controlled by the manipulation of the soft and bright pedals.

In the following, the key processing routine using such pedal manipulation will be described with reference to FIGS. 7A and 7B.

Figure 7A:
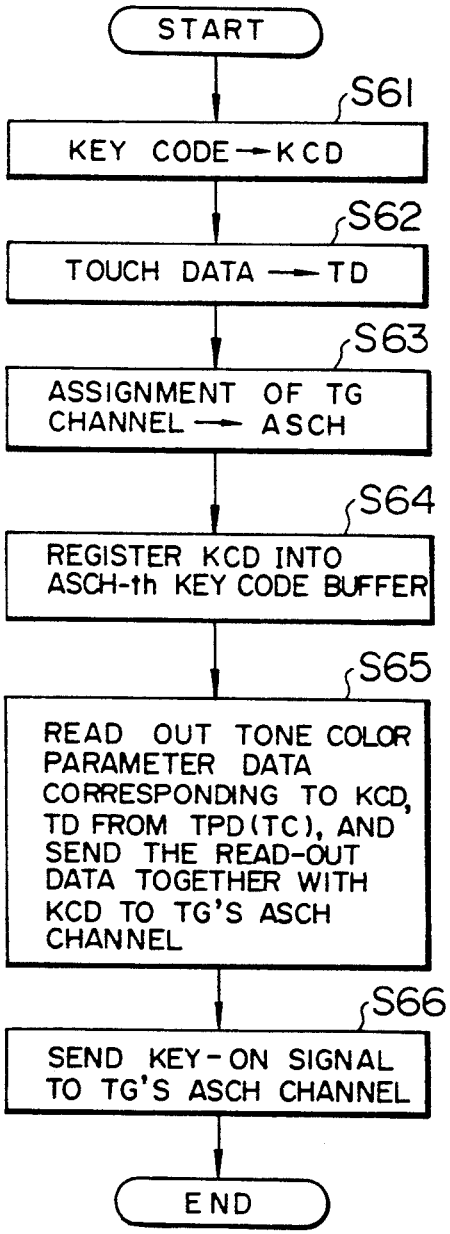

FIG. 7A is a flow chart of the key on event routine. When the processing is started, the depressed key is detected and the key code thereof is registered in the register KCD (the step S61). Then, the touch of the key depression is detected as a touch data and registered in the register TD.

A channel selected from vacant channels of the tone generator is assigned for tone generation and the channel number thereof is registered in the register ASCH (the step S63).

The key code KCD is registered in the ASCH-th key code buffer thus assigned (the step S64). That is, a preparation is made for generating a musical tone having a pitch of KCD from the ASCH-th channel of the tone generator.

In the next step S65, tone color parameter data corresponding to both the key code KCD and the touch data TD are read from the tone parameter data TPD (TC) and sent together with the key code KCD to the ASCH-th channel of the tone generator.

Then, a key-on signal is sent to the ASCH-th channel of the tone generator (the step S66) to generate a musical tone. As a result, a musical tone corresponding to the manipulation of the bright/soft pedal is generated.

Figure 7B:
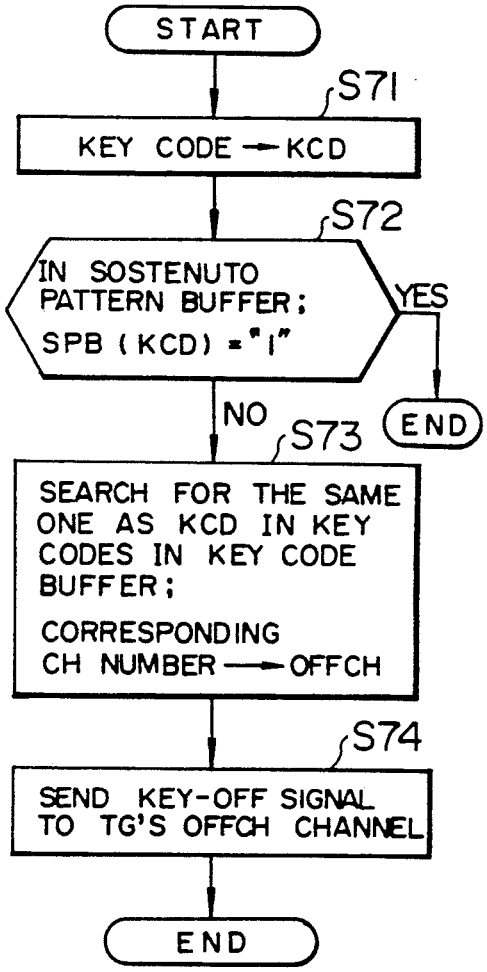

FIG. 7B shows the key off event routine.

When the processing is started, the release of a key is detected and a key code corresponding to the key is inputted into the register KCD (the step S71).

Then, a judgement is made as to whether a corresponding position SPB(KCD) of the sostenute pattern buffer SPB is "1" or not (the step S72).

When SPB(KCD) is "1", the processing is terminated soon to give such a sostenute effect as the musical tone decays naturally.

When SPB(KCD) is not "1", the key code buffer having the designated key code is searched for the same key code as KCD in the step S73. The number of a corresponding channel thus detected is registered in the register OFFCH.

Then, in the step S74, a key-off signal is sent to the OFFCH-th tone generation channel of the tone generator to stop tone generation. If there is no OFFCH, the key-off signal is not yet sent because tone erasing has been made already. The tone erasing is carried out by using the manipulation of the damper pedal.

That is, in an ordinary mode, a key-off signal is sent out on the basis of the key release to carry out the tone erasing. However, when the sostenute effect is given, the key-off signal is not sent out specially so that the musical tone decays naturally.

Although the aforementioned embodiment has shown the case where a digital filter is used so that the bright/soft control is made by controlling the cut-off frequency of the digital filter, the present invention can be applied to the case where the same control may be made by using a digitally controlled analog equalizer after D/A conversion in the tone generator.

A "switch for changing over the pedal function" as described in the prior art as well as for changing over the pedal function corresponding to the tone color may be further provided.

As described above, because the effect of controlling the pedal corresponding to the tone color is selected automatically when the tone color is designated, the pedal can be used effectively.

Having described the present invention in conjunction with the preferred embodiments thereof, the present invention is not limited to the specific embodiments. For example, it will be self-evident that various changes, improvements, combinations and the like may be made.

What is claimed is:

1. An electronic musical instrument comprising:

tone generation means for generating a musical tone;

pitch designation means for designating pitch of a musical tone to be generated by the tone generation means;

tone color designation means for designating tone color of said musical tone;

effect designation means for designating one of a plurality of different effects in response to a tone color designated by said tone color designation means;

at least one performance manipulator for manipulating said musical tone in accordance with the one of a plurality of different effects designated by said effect designation means; and tone generation control means for controlling tone generation in said tone generation means to generate a musical tone having the pitch designated by the pitch designation means, the tone color designated by the tone color designation means and the one of a plurality of different effects designated by the effect designation means in an amount corresponding to the manipulation of said performance manipulator;

said performance manipulator generating an output signal at one of a plurality of discrete levels corresponding to the amount of the manipulation, the one of the plurality of discrete levels when the amount of the manipulation is increasing being different from the one of the plurality of discrete levels when the amount of the manipulation is decreasing.

2. An electronic musical instrument according to claim 1, in which said at least one performance manipulator includes a foot pedal, and wherein each of the plurality of different effects defines a different function of the foot pedal so that the function of the foot pedal is changed in response to designation of a tone color.

3. An electronic musical instrument according to claim 2, further comprising another foot pedal for making manipulation to give a predetermined effect, in which the effect of one foot pedal is opposite the effect of the other foot pedal with respect to a predetermined tone color.

4. An electronic musical instrument having:

a performance information generating means for generating at least note-on and note-off signals;

a musical tone waveform generating means for generating a musical tone waveform signal in which the envelope thereof has an attack portion started in response to said note-on signal and a release portion started in response to said note-off signal;

a performance manipulator for generating a release control signal which changes in multiple levels corresponding to the amount of manipulation thereof, said performance manipulator having a hysteresis characteristic providing that the amount of manipulation required for shifting from one of the multiple levels to an adjacent one of the multiple levels when the amount of manipulation is increasing is larger than the amount of manipulation required for shifting from said adjacent one of the multiple levels to said one of the multiple levels when the amount of manipulation is decreasing; and control means for changing the decay rate of the release portion of the envelope of said musical tone waveform signal on the basis of said release control signal.

* * * * *